United States Patent [19]

Elliott et al.

[11] 4,087,339

[45] May 2, 1978

[54] ELECTROWINNING OF SULFUR-CONTAINING NICKEL

[75] Inventors: Robert William Elliott, Mississauga; John Ambrose, Oakville; Victor Alexander Ettel, Mississauga, all of Canada

[73] Assignee: The International Nickel Company, Inc., New York, N.Y.

[21] Appl. No.: 758,483

[22] Filed: Jan. 11, 1977

[30] Foreign Application Priority Data

Jul. 2, 1976 Canada ..... 256198

[51] Int. Cl.[2] ..... C25C 1/08; C25C 7/04

[52] U.S. Cl. ..... 204/112; 204/258

[58] Field of Search ..... 204/112, 275, 278, 258

[56] References Cited

U.S. PATENT DOCUMENTS

| | | | |
|---|---|---|---|
| 2,392,708 | 1/1946 | Tschop | 204/292 |
| 2,453,757 | 11/1948 | Renzoni | 204/37 |
| 2,480,771 | 8/1949 | Renzoni | 204/112 |
| 2,623,848 | 12/1952 | Renzoni | 204/112 |
| 3,855,089 | 12/1974 | McCutchen et al. | 204/105 M |
| 3,959,111 | 5/1976 | Mardine et al. | 204/258 |

FOREIGN PATENT DOCUMENTS

| | | | |
|---|---|---|---|
| 992,767 | 5/1965 | United Kingdom | 204/112 |

*Primary Examiner*—T. M. Tufariello

*Attorney, Agent, or Firm*—Lewis Messulam; Ewan C. MacQueen

[57] ABSTRACT

Sulfur-containing nickel is electrodeposited from a chloride electrolyte in a cell wherein each cathode is separated from any adjacent anode by a pair of diaphragms.

6 Claims, 3 Drawing Figures

ELECTROWINNING OF SULFUR-CONTAINING NICKEL

The present invention relates to an improved process for electrolytically producing sulfur-containing nickel.

As is well known the presence of a small amount of sulfur, e.g., 50–250 parts per million (ppm) in a nickel anode is highly beneficial to ensure activation of the anode and hence uniform corrosion when it is used for electroplating. Such sulfur-containing nickel anodes were initially produced by melting techniques using electrolytically pure nickel and adding sulfur thereto. A major step forward consisted in the formulation of processes for electrodepositing sulfur-containing nickel. Such processes are described for example, in U.S. Pat. Nos. 2,392,708 (issued to H. E. Tschop) and 2,453,757 and 2,623,848 (both issued to L. S. Renzoni). Generally such processes involve electrorefining an impure nickel anode in an electrolyte containing a sulfur-bearing agent such as sulfur dioxide, or a sulfite, bisulfite or thiosulfate of an alkali metal.

More recent improvements in the art of nickel electrodeposition have led to development of various electrowinning processes in which insoluble anodes are used. Unlike electrorefining operations where the overall reaction is the dissolution of an impure nickel anode and deposition of a pure nickel cathode, in electrowinning processes the nickel concentration in the electrolyte is merely depleted by the cathodic electrodeposition and typically it is replenished by recycling the spent electrolyte to a leaching or a solvent extraction operation.

The so called "all chloride" electrowinning process, wherein all of the nickel in the electrolyte is in the form of nickel chloride is particularly attractive in that it offers considerable savings in both capital and operating costs over sulfate or mixed sulfate-chloride electrowinning processes. However, for the purpose of depositing sulfur-containing nickel it has not been possible heretofore to resort to electrowinning from chloride-containing electrolytes. The reason for this is that when chloride ions are present in the electrolyte, chlorine is liberated at the insoluble anode, and the presence of chlorine in the electrolyte tends to inhibit sulfur deposition. Thus even though a diaphragm is used to separate the catholyte from the anolyte when carrying out electrowinning, chlorine generated at the anode tends to diffuse to the catholyte.

It is an object of the present invention to provide an electrowinning process for depositing sulfur-containing nickel from a chloride-containing electrolyte, and in particular from an "all-chloride" electrolyte.

Generally speaking the present invention provides a process whereby sulfur-containing nickel is electrowon from a chloride-containing nickel electrolyte which has dissolved therein a small but effective amount of sulfur dioxide, thiourea, toluene sulfonamide or a sulfite, bisulfite, thiosulfate or tetrathionate of an alkali or alkaline earth metal. The electrowinning is conducted in a cell including one or more electrode assemblies, each assembly comprising a substantially insoluble anode, a cathode, anolyte diaphragm-means for enveloping the anode and a volume of electrolyte adjacent thereto, and catholyte diaphragm-means for enveloping the cathode and a volume of electrolyte adjacent thereto. In this way the diaphragm-means define catholyte and anolyte compartments which are separated from one another by two porous diaphragms with electrolyte therebetween. In operation a hydrostatic head of pressure is maintained in the catholyte compartment by introducing fresh electrolyte only into this compartment and withdrawing spent electrolyte only from the exterior of the catholyte compartment.

It is preferable to withdraw electrolyte from the anolyte compartment, thereby establishing a flow of electrolyte within the cell, through both of the diaphragms, from catholyte to anolyte compartments via the remainder of the cell volume which can be termed for convenience 'the intermediate compartment.' Such a flow pattern aids in preventing the undesired diffusion to the catholyte of chlorine generated at the anode. However withdrawal of electrolyte from the anolyte compartment is in no way essential and withdrawal from the intermediate compartment has been found satisfactory.

The diaphragm-means referred to herein may be any diaphragm-containing assembly which is adapted to house part of the electrolyte in the cell so that communication between the housed electrolyte and the bulk electrolyte in the intermediate compartment can take place only via the porous diaphragm. This can be achieved by resorting to a rigid assembly, i.e an electrode box, wherein at least one side of the assembly consists of a porous diaphragm. Alternatively the assembly may consist entirely of the porous diaphragm, i.e. it may comprise an electrode bag which envelops at least the immersed portion of the electrode. The invention is in no way restricted to any particular type of diaphragm assembly and, for example, in the specific tests referred to below use was made of a cell which incorporated both the above-mentioned types of assembly.

In order to ensure the efficient removal, from the vicinity of the anode, of chlorine evolved during the electrowinning, it is preferred that the cell used in carrying out the process of the invention incorporate anode cover-means in the form of an anode hood which is suitably shaped and positioned to seal off the space above the anolyte surface. Where the anode is boxed, the hood may conveniently be adapted to engage mechanically with the anode box. Where use is made of an anode bag, it will be convenient to use a hood which is so dimensioned and positioned that its lower edge, in operation, is immersed below the electrolyte level and encircles the anode bag.

The use of both anolyte and catholyte diaphragms is essential to the success of the process of the invention, in that a single diaphragm, whether it be around the anode or around the cathode, has proved incapable of effectively preventing the diffusion of chlorine to the catholyte where it inhibits sulfur deposition. Attempts at overcoming this problem by suitable selection of the porosity of the membrane used as diaphragm are frustrated by the fact that any excessive decrease in the permeability of the membrane will unduly impede the desired ionic flow through the diaphragm. By resorting to the double diaphragm cell referred to above, the problem of chlorine diffusion is overcome without critical requirements on the degree of permeability of the membranes used. Indeed many materials, such as various synthetic fabrics, which have in the past been advocated for use as porous membranes in chloride electrolytes, may constitute the diaphragms in the cell used for carrying out the process of the invention. A double-diaphragm cell has been advocated in the art only as a means for maintaining different ionic species in the anolyte and catholyte compartments. Thus in U.S. Pat. No. 2,578,839 (issued to L. S. Renzoni) a double-diaphragm cell is used to maintain a sulfate anolyte and a chloride catholyte. Such a cell has never been used, so far as we are aware, with the same ionic species being present in anolyte and catholyte compartments as described herein for depositing sulfur bearing nickel from a chloride electrolyte. Thus whereas the process described in the above-mentioned U.S. Pat. No. 2,578,839 involves the prevention of chlorine liberation at the anode, the present invention is based on the simpler procedure of preventing anodically liberated chlorine from impeding sulfur deposition at the cathode.

The anode of the electrowinning cell must be substantially inert under the cell operating conditions. Typical materials suitable for use as insoluble anodes include for example graphite, or titanium having a platinum-group metal coating thereon. The cathode may consist of a nickel starter sheet or a reusable inert electrode such as titanium.

The composition of the electrolyte used in carrying out the process of the invention is not critical, but it is advantageous to use "all-chloride" electrolytes. Inasmuch as the electrowinning of sulfur-free nickel from chloride-containing electrolytes is known in the art, the interrelation of cell voltage and current density with the electrolyte composition, temperature, pH and flow rate are not discussed in detail herein. The electrolytes used in the process of the invention differ of course from such prior electrowinning electrolytes by virtue of the presence in the former of the sulfur-bearing compounds. However, it has been found that the presence of these compounds does not materially affect the electrowinning operation parameters applicable.

A particular reason for favoring "all-chloride" electrolytes lies in the ability to achieve efficiently a high nickel bite when such electrolytes are used, i.e. a large difference between the nickel contents of the fresh and spent electrolytes. For this purpose, a preferred combination of electrowinning conditions comprises using an aqueous solution containing about 150 to 255 grams per liter of nickel as nickel chloride, up to about 20 grams per liter of boric acid and about 50 to 160 milligrams per liter of thiosulfate ions in the form of sodium thiosulfate. The pH of the solution is adjusted to between about −1.5 and 4.0, measured at room temperature, prior to feeding it into the cell which is maintained at about 50°–100° C. The flow rates of the electrolyte into and out of the cell are controlled to give a nickel bite of the order of at least 70 grams per liter and more preferably at least 150 grams per liter.

Some examples of the production of sulfur-containing nickel in accordance with the process of the invention will now be described with reference to the accompanying drawings.

DETAILED DESCRIPTION

EXAMPLES

Figure 1:
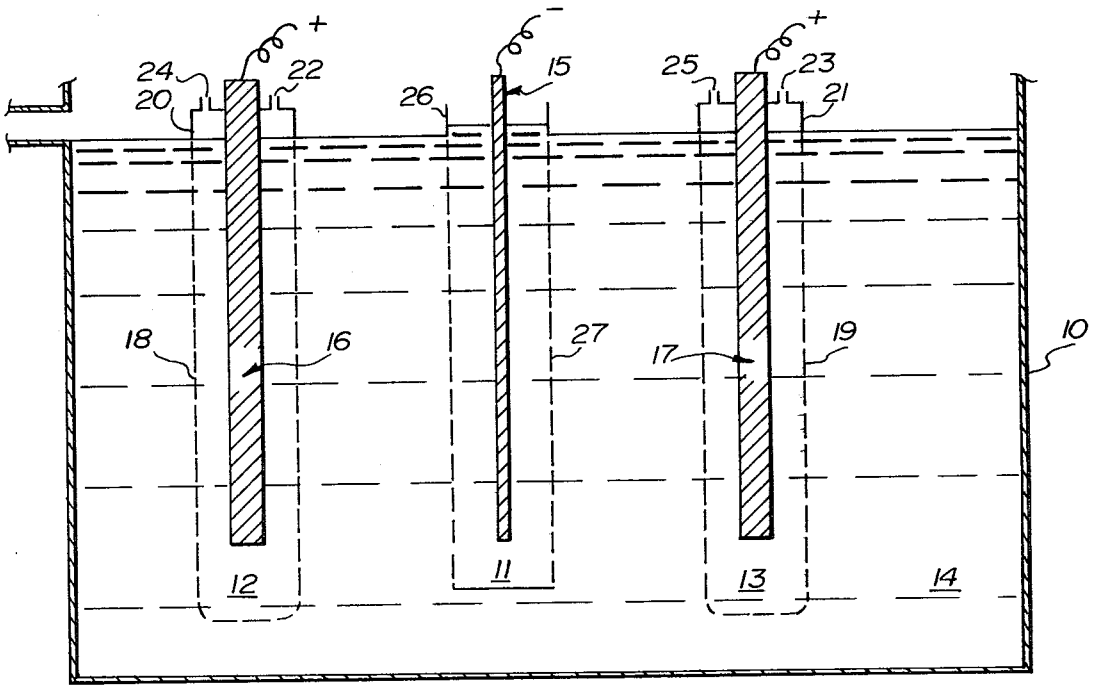
FIG. 1 illustrates an electrowinning cell used for the tests described below.

A series of tests were performed in the apparatus shown in FIG. 1. This consisted of a 22 liter cell 10 which was divided into four compartments consisting of a catholyte compartment 11, two anolyte compartments 12 and 13, while the fourth compartment 14 comprised the remainder of the cell volume, i.e. an intermediate compartment containing the bulk electrolyte.

The electrodes consisted of a single cathode 15 in the form of a sandblasted sheet of titanium measuring: 38 cm × 7 cm, and a pair of graphite anodes 16 and 17 located one on either side of the cathode 15 and spaced by 6.5 centimeters from the surface thereof. The anodes were enclosed in synthetic bags 18 and 19 and covered by fiber-glass hoods 20 and 21 the lower edges of which were immersed below the level of the bulk electrolyte in the compartment 14. The anode hoods were provided with inlets conduits 22 and 23 for admitting air to the space above the anolyte and thus aiding the purging of chlorine away from the anodes through outlets 24 and 25.

The titanium cathode of the cell was contained in a cathode box consisting of a fiber-glass framework 26 and synthetic fabric membranes 27. The electrolyte was introduced into the catholyte compartment at a pH of about 3.5, measured at room temperature, and spent electrolyte was withdrawn from the bulk electrolyte compartment, the flow rates being controlled to achieve a nickel bite of 160 ± 20 grams per liter. During the electrowinning the electrolyte within the cell was maintained at 70° C. A cell voltage of 2.8 volts provided a current density of 400 amperes per square meter of cathode (amp/m$^2$), and the operational pH was monitored, at the operating temperature, in both the catholyte and bulk electrolyte.

The electrolytes used were "all-chloride" electrolytes differing from one another essentially only in the concentration of sulfur-bearing agent present therein. In each of Tests Nos. 1–3 the electrolyte comprised an aqueous solution containing 240 grams per liter of nickel as nickel chloride, 10 grams per liter of boric acid and between 50 and 160 milligrams per liter of thiosulfate ions as sodium thiosulfate. After electrodeposition the nickel on both faces of the cathode was assayed for sulfur and each of the sulfur contents shown in Table 1 below represents the average from both cathode faces.

TABLE 1

| Test No | $S_2O_3$-Thiosulfate (mg/l) | pH (at 70° C) Bulk | pH (at 70° C) Catholyte | S in Deposit (ppm) |
|---|---|---|---|---|
| 1 | 160 | 1.9 | 2.2 | 220 |
| 2 | 100 | 1.6 | 2.0 | 143 |
| 3 | 50 | 1.4 | 1.6 | 59 |

A comparative test was carried out in an apparatus including only a single diaphragm between anolyte and catholyte. An electrolyte of a similar composition to that described above was used, containing in this case 200 mg/l of thiosulfate ions, and the electrodeposition parameters were similar to those described above, the bulk pH being 1.8 at the operating temperature of 70° C. It was found that the deposited nickel contained only 3 ppm of sulfur. The results of Tests Nos. 1–3 show that the double-diaphragm procedure effectively prevented the sulfur deposition from being inhibited by the anodically evolved chlorine.

Chlorine assays of the electrolyte in the tests according to the invention showed amounts between 0.2 and 0.8 grams per liter of free chlorine in the spent electrolyte withdrawn from the bulk compartment, whereas no chlorine at all was detected in the catholyte. These assays suggest that when only a single diaphragm separates catholyte from anolyte, the catholyte would be expected to contain up to about 0.8 grams per liter of free chlorine. Such a level of free chlorine in the catholyte has been found to inhibit sulfur deposition.

Further tests were carried out using different sulfur-bearing agents. The apparatus used for these tests was a bench-scale version of that used for Tests Nos. 1–3. Apart from the sulfur-bearing agents, the electrolytes contained about 200 g/l of nickel as nickel chloride and about 10 g/l of boric acid. Electrodeposition was carried out at about 70° C with a cathodic current density of about 600 amp/m$^2$ and nickel bite of about 85 g/l. The results obtained are shown in Table 2 below.

TABLE 2

| Test No | S-bearing Additive | mg/l of Additive | S in Deposit (ppm) |
|---|---|---|---|
| 4 | Sodium Bisulfite | 100 | 45 |
| 5 | Sodium Tetrathionate | 100 | 190 |
| 6 | Thiourea | 100 | 235 |

Thus it will be seen that various sulfur-bearing additives can be used successfully in practising the process of the invention.

Figure 2:
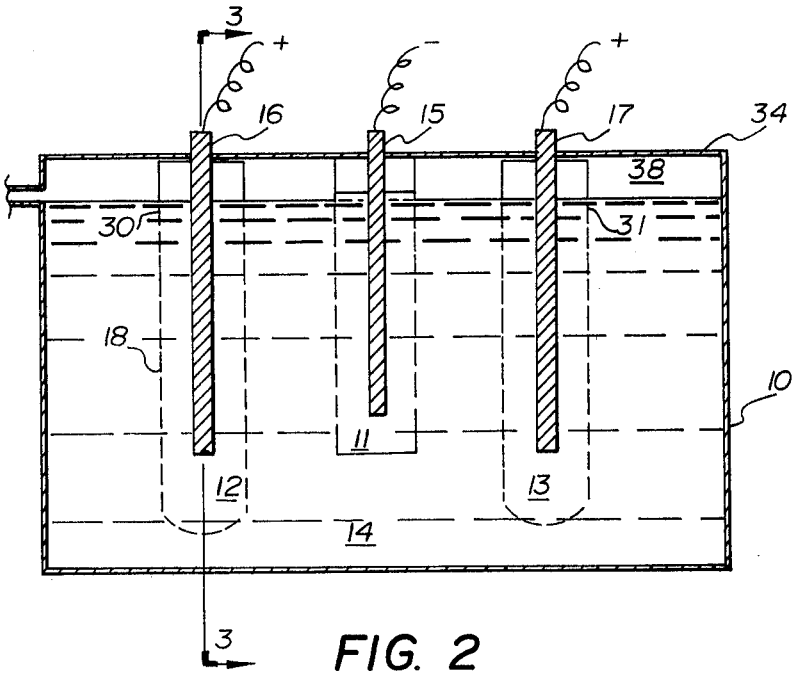
FIG. 2 illustrates an electrowinning cell of alternative design more suitable for carrying out the process of the invention on a commercial scale.
Figure 3:
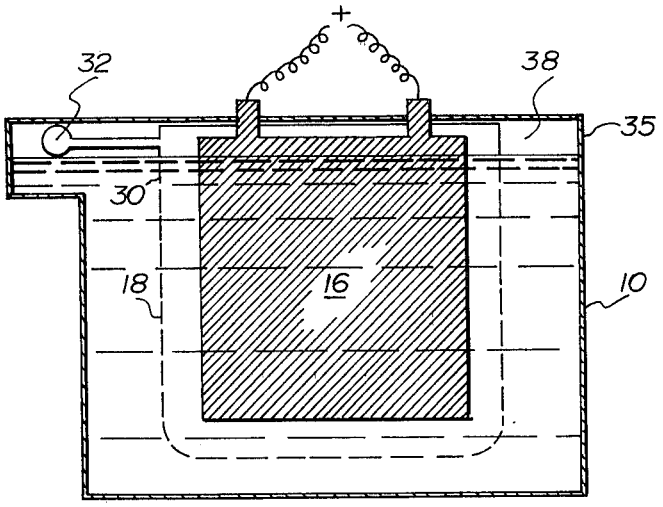
FIG. 3 represents a section through the line 3—3 of FIG. 2.

Referring now to FIGS. 2 and 3, these show a preferred apparatus suitable for practising the process of the invention on a commercial scale. Essentially this apparatus differs from that of FIG. 1 in that:

a. a source of reduced pressure is used instead of air purging to remove the anodically liberated chlorine; and b. a cell cover is provided to enclose essentially the space above the bulk electrolyte compartment.

No detailed description will be given of components of this preferred apparatus which are identical to components of the apparatus of FIG. 1. Such like components are designated by the same reference numerals as used in FIG. 1. The anodes are covered by hoods 30 and 31 respectively, and the whole of the cell is covered by a lid 34. As is seen from FIG. 3, the anode hood 30 is provided with a port 32 through which the space above the anolyte can be evacuated by means of a source of reduced pressure (not shown). The cell lid 34 serves to enclose the header space 38 above the bulk electrolyte compartment 14. The lid is provided with an aperture through which the cathode can be inserted into and withdrawn from the catholyte compartment, and with a vent 35 through which air enters the header space 38 when the latter is continuously evacuated by means not illustrated. The sweeping of the header space with air in this manner serves to remove electrolyte fumes and also removes any chlorine which may leak into that space from the anolyte compartment.

While the present invention has been described with reference to preferred embodiments thereof, it will be understood that various modifications may be made in terms of the electrolyte composition, the design as well as operating conditions of the cell without departing from the scope of the invention which is defined by the appended claims.

We claim:

1. A process for producing sulfur-containing nickel comprising establishing an aqueous electrolyte which contains in solution nickel ions, chloride ions and a sulfur-bearing compound selected from the group consisting of sulfur dioxide, thiourea, toluene sulfonamide as well as sulfites, bisulfites, thiosulfates and tetrathionates of alkali and alkaline earth metals, electrodepositing nickel from said electrolyte in a cell having at least one electrode assembly, which assembly comprises an anode substantially insoluble in said electrolyte, a cathode, an anolyte diaphragm-means for isolating said anode and a volume of said electrolyte adjacent thereto from the remainder of said electrolyte within said cell and a catholyte diaphragm-means for isolating said cathode and a volume of said electrolyte adjacent thereto from the remainder of said electrolyte within said cell, and maintaining a flow of said electrolyte through said cell during electrodeposition by introducing fresh electrolyte to the interior only of said catholyte diaphragm-means and withdrawing spent electrolyte from the exterior only of said catholyte diaphragm-means.

2. A process as claimed in claim 1 wherein said cell includes anode cover-means so dimensioned and positioned relative to said anolyte diaphragm-means as to define a substantially sealed space above said anolyte diaphragm-means.

3. A process as claimed in claim 2 wherein substantially all of said nickel in said electrolyte is in the form of nickel chloride.

4. A process as claimed in claim 3 wherein said sulfur-bearing compound comprises an alkali metal thiosulfate.

5. A process as claimed in claim 4 wherein said electrolyte contains about 150–255 grams per liter of nickel, up to about 20 grams per liter of boric acid and about 50–160 milligrams per liter of thiosulfate ions.

6. A process as claimed in claim 5 wherein the rate of introduction of fresh electrolyte into said cell and the rate of withdrawal of spent electrolyte therefrom are controlled so as to maintain a difference of at least 70 grams per liter between the nickel contents of said fresh and spent electrolytes.

* * * * *